US005986237A

United States Patent [19]

Sterling et al.

[11] Patent Number: 5,986,237

[45] Date of Patent: Nov. 16, 1999

[54] METHOD FOR THAWING FROZEN ROAD CULVERTS

[75] Inventors: Robert Laurel Sterling, Grande Prairie; Rudiger Schmidt, Wainwright, both of Canada

[73] Assignee: Iceworm International Inc., Alberta, Canada

[21] Appl. No.: 08/936,825

[22] Filed: Sep. 25, 1997

[51] Int. Cl.[6] ..... H05B 1/00; H01C 3/06

[52] U.S. Cl. ..... 219/213; 219/549; 338/214

[58] Field of Search ..... 219/213, 528, 219/544, 538, 546; 404/77, 79; 405/131, 128; 338/214

[56] References Cited

U.S. PATENT DOCUMENTS 1,349,136 8/1920 Lillard .

3,823,304 7/1974 Siemianowski ..... 219/213

*Primary Examiner*—Teresa Walberg
*Assistant Examiner*—Thor S. Campbell
*Attorney, Agent, or Firm*—Davis and Bujold

[57] ABSTRACT

A method for thawing frozen road culverts. The first step involves positioning an electrically conductive cable in a road culvert prior to an ice blockage occurring. A connection end of the electrically conductive cable is anchored in an accessible location. The second step involves connecting a power source to the connection end of the electrically conductive cable after an ice blockage of the road culvert has occurred and supplying power to the electrically conductive cable, such that energy generated by power flowing through the electrically conductive cable causes a flow path to be created through the ice blockage in the road culvert.

7 Claims, 2 Drawing Sheets

METHOD FOR THAWING FROZEN ROAD CULVERTS

FIELD OF THE INVENTION

The present invention relates to a method for thawing frozen road culverts.

BACKGROUND OF THE INVENTION

With the coming of spring every year there is a daily cycle of melting and freezing. The heat of the sun during the day causes snow to melt. As the sun goes down the temperature falls and water resulting from melting of the snow freezes.

Culverts are strategically placed under roads which are in a path followed by a flow of water from the melting snow. The culverts divert the flow of water so the road does not wash out. Unfortunately, the daily cycle of melting and freezing sometimes results in a culvert becoming blocked by an ice plug. If the ice plug is not removed in a timely fashion, the flow of water seeks an alternative path which often results in a washing out of portions of the road.

At the present time, steam truck crews are dispatched whenever it is noted that a culvert is plugged by ice. Removal of an ice plug from a culvert is generally a slow process. High pressure steam is injected into the ice plug, usually from a downstream side of the culvert, until a flow of water is restored. An ice plug that extends part way into a culvert generally can be removed by high pressure steam within three hours. Ice plugs that extend completely through a culvert can take considerably longer to remove.

The problem of road culverts plugging with ice has become so prevalent, that oversize culverts are frequently used for the express purpose of reducing the frequency of the problem.

SUMMARY OF THE INVENTION

What is required is a more time efficient method of thawing frozen road culverts.

According to one aspect of the present invention there is provided a method for thawing frozen road culverts. The first step involves positioning an electrically conductive cable in a road culvert prior to an ice blockage occurring. A connection end of the electrically conductive cable is anchored in an accessible location. The second step involves connecting a power source to the connection end of the electrically conductive cable after an ice blockage of the road culvert has occurred and supplying power to the electrically conductive cable, such that energy generated by power flowing through the electrically conductive cable causes a flow path to be created through the ice blockage in the road culvert.

According to another aspect of the present invention, there provided, a combination including a road culvert and an electrically conductive cable. The road culvert has an interior bore with an upstream end and a downstream end relative to normal water flow. The electrically conductive cable is positioned in the interior bore and extends substantially the length of the road culvert from the upstream end toward the downstream end. A connection end of the electrically conductive cable is anchored in an accessible location, such that a power source connectable to the connection end of the electrically conductive cable to supply power to energize the electrically conductive cable.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
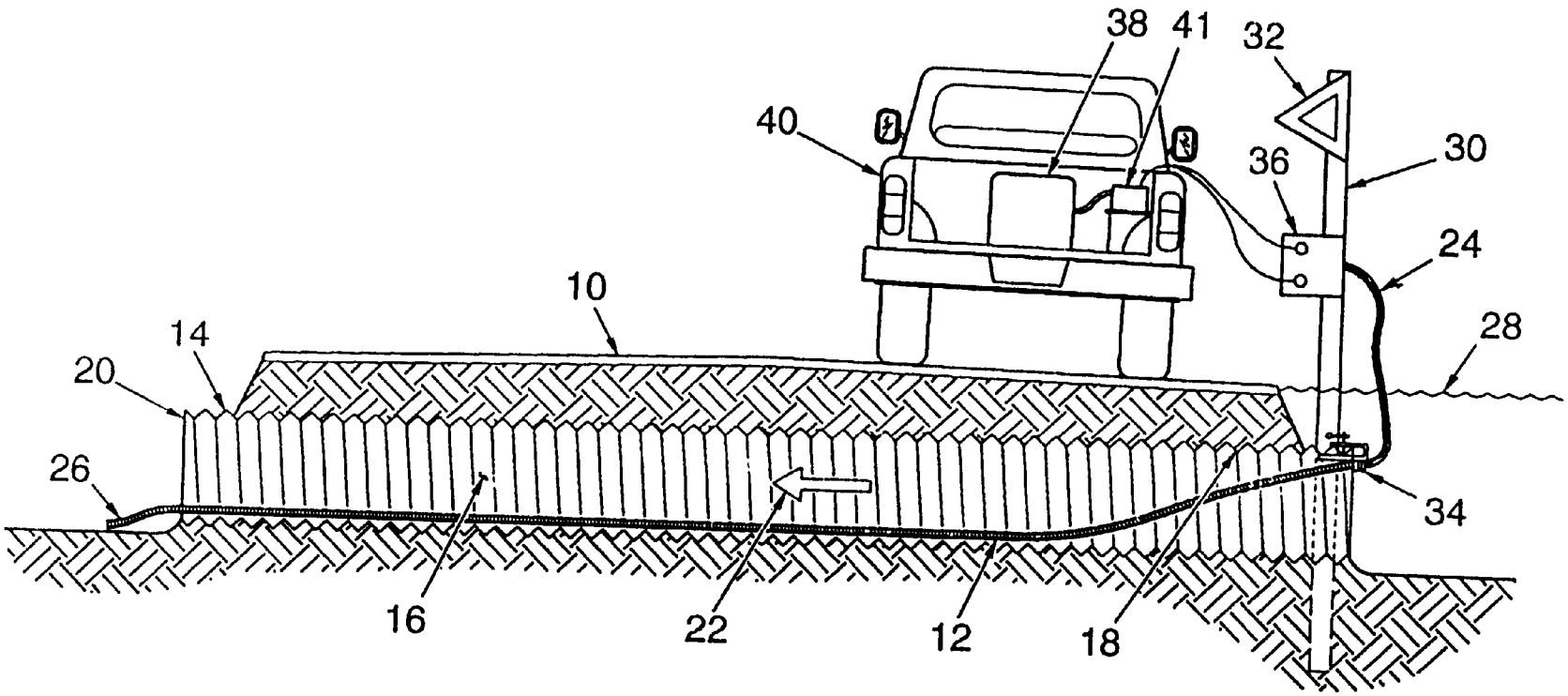
FIG. 1 is a front elevation view, in section, of a culvert that has been equipped with an electrically conductive cable in accordance with the teachings of the present method.

The preferred method for thawing frozen road culverts will now be described with reference to FIG. 1.

The teachings of the preferred method, as will hereafter be further described, require that an electrically conductive cable 12 be positioned in a road culvert 14. Road is generally indicated by reference numeral 10. Road culvert 14 has an interior bore 16 with an upstream end 18 and a downstream end 20 relative to a direction of normal water flow as indicated by arrow 22. Electrically conductive cable 12 has a connection end 24 and a remote end 26. Beneficial results have been obtained using electrically conductive cable 12 made from #10 insulated copper wire, although in applications requiring higher temperatures wire made from alloys that can withstand higher temperatures may be used. Electrically conductive cable 12 is positioned in interior bore 16 of road culvert 14 and, preferably, extends substantially the length of road culvert 14 from upstream end 18 toward downstream end 20. It is essential that electrically conductive cable 12 is positioned at upstream end 18, for it is at upstream end 18 that a lockage by ice is most likely to occur. It is not always ssential that electrically conductive cable 12 reach all the ay to downstream end 20. Each installation must be made having regard to surface topography and other conditions prevailing. Some road culverts become blocked at both ends, others are prone only to upstream blockage. Connection end 24 of electrically conductive cable 12 is anchored in an accessible location. When choosing an accessible location must bear in mind the conditions that will prevail when an ice blockage condition is encountered. There is likely to be an accumulation of water upstream of road culvert 14, so the accessible location ispeferably above a high water mark generally indicated by reference numeral 28. There is also likely to be an accumulation of snow on the ground, so connection end 24 is preferably a sufficient height to be above any accumulation of snow. In order to achieve this objective, it is preferred that connection end 24 be mounted onto a post 30. Post 30 can be marked with a sign 32 or otherwise marked so as to be readily identified by work crews. In order to ensure that electrically conductive cable 12 does not shift after installation, it is preferred that electrically conductive cable 12 be clamped by means of clamp 34 to upstream end 18 of road culvert 14. Connection end 24 of electrically conductive cable 12 is preferably is connected to a junction box 36. A power source 38 is used to supply power to electrically conductive cable 12. For safety reasons, a low voltage direct current power source which generates six to forty volts is preferred. It will be appreciated that the power required will vary with the gauge and length of electrically conductive cable 12 used. It is not viewed as being cost effective to have a power source at every installation. It is viewed as being more practical to take power source 38 to the particular road culvert that is blocked, it is, therefore, preferred that power source 38 be mounted on a truck 40. For reasons of safety, it is preferred that power source 38 have a control box 41 which include features that control current and provide overcurrent protection with a breaker trip mechanism.

The use and operation of the above described combination in accordance with the teachings of the preferred method will now be described. The first step involves positioning electrically conductive cable 12 in road culvert 14 prior to an ice blockage occurring. Of course, after an ice blockage has occurred it is too late to insert electrically conductive cable 12. Historical data can be used to select those of road culverts 14 that are most prone to ice blockage. Connection end 24 of electrically conductive cable 24 is anchored in an accessible location, such as post 30. It is preferred that cable be secured to road culvert 14 at upstream end 18 by means of clamp 34. Cable 24 is then laid through road culvert 14.

The second step involves connecting power source 38 to connection end 24 of electrically conductive cable 12 after an ice blockage (not shown) of road culvert 14 has occurred. As low voltage power source 38 is truck mounted, truck 40 can be dispatched. The connection of power source 38 to connection end 24 of electrically conductive cable 12 is made through junction box 36. Power source 38 provides power to electrically conductive cable 12. Tests have shown that energy generated by electrically conductive cable 12 causes a flow path to be created through the ice blockage in the immediate vicinity of electrically conductive cable 12. The resulting flow of water then tends to accelerate the process of removing the blockage by rapidly washing away the ice. A trickle of water through road culvert 14 generally occurs in as little as two minutes and normal flow through road culvert 14 is generally restored within ten minutes. The rapid clearing of the blockage is believed to be due to more than just the heat generated by power passing through electrically conductive cable 12.

Figure 2:
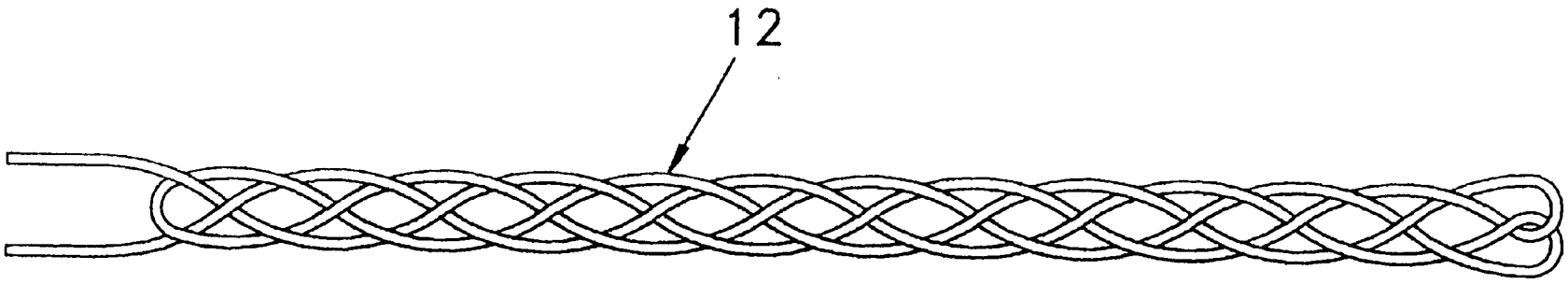
FIG. 2 is a detailed top plan view of a electrically conductive cable illustrated in FIG. 1.

Referring to FIG. 2, in addition to thermal energy, there is believed to be an eddy current induced. In order to enhance this effect cable 12 is looped lengthwise back and forth in boustrophedonic fashion. The loops are then twisted together in order to make cable 12 more compact and easier to handle. Regardless of what forces are at work, the energy generated can be objectively shown to clear an ice blockage in a remarkably short time.

It will be apparent to one skilled in the art that modifications may be made to the illustrated embodiment without departing from the spirit and scope of the invention as hereinafter defined in the Claims.

The embodiments of the invention in which an exclusine property or privilege is claimed are defined as follows:

1. A method for thawing frozen road culverts, comprising the steps of:

positioning an electrically conductive cable in a road culvert prior to an ice blockage occurring, with a connection end of the electrically conductive cable anchored in an accessible location;

dispatching a mobile low voltage power source to the road culvert when a blockage occurs; and connecting the power source to the connection end of the electrically conductive cable and supplying power to the electrically conductive cable, such that energy generated by power flowing through the electrically conductive cable causes a flow path to be created through an ice blockage in the road culvert.

2. In combination:

a road culvert having an interior bore;

an electrically conductive cable positioned in the interior bore and extending substantially the length of the road culvert;

a connection end of the electrically conductive cable being anchored in an accessible location, such that a power source is connectable to the connection end of the electrically conductive cable to supply power to energize the electrically conductive cable; and a mobile low voltage power source for supplying power to the electrically conductive cable.

3. The combination as defined in claim 2, wherein the road culvert has with an upstream end and a downstream end relative to normal water flow, the cable extending from the upstream end toward the downstream end.

4. The combination as defined in claim 2, wherein the cable is looped lengthwise back and forth in boustrophedonic fashion.

5. The combination as defined in claim 4, wherein the cable is twisted.

6. A method for thawing frozen road culverts, comprising the steps of:

positioning an electrically conductive cable in a road culvert prior to an ice blockage occurring, with a connection end of the electrically conductive cable anchored in an accessible location outside the road culvert and an opposite end of the cable being unattended and extending completely through the road culvert and projecting out through the opposite end thereof;

dispatching a mobile low voltage power source to the road culvert when a blockage occurs in the road culvert; and connecting the power source to the connection end of the electrically conductive cable and supplying electrical power to the electrically conductive cable, such that energy generated by the electrical power flowing through the electrically conductive cable causes a flow path to be created through the ice blockage in the road culvert thereby assisting with thawing of the road culvert.

7. The combination of claim 2 wherein the accessible location of the connection end of the cable is located outside the road culvert so as to be accessible.

* * * * *